United States Patent [19]

LeBaron

[11] Patent Number: 4,673,310

[45] Date of Patent: Jun. 16, 1987

[54] METHOD OF AND APPARATUS FOR ADJUSTABLY LEVELING MANHOLE COVERS, GRATES AND THE LIKE

[75] Inventor: Francis LeBaron, West Bridgewater, Mass.

[73] Assignee: E.L. LeBaron Foundry Co., Brockton, Mass.

[21] Appl. No.: 843,931

[22] Filed: Mar. 24, 1986

Related U.S. Application Data

[63] Continuation of Ser. No. 551,583, Nov. 14, 1983, abandoned.

[51] Int. Cl.[4] ..... E02D 29/14

[52] U.S. Cl. ..... 404/26

[58] Field of Search ..... 404/4, 5, 22, 25, 26, 404/82; 52/19-21; 210/163, 164, 165, 166

[56] References Cited

U.S. PATENT DOCUMENTS

| | | | |
|---|---|---|---|
| 638,692 | 1/1899 | Banwell . | |
| 711,465 | 10/1902 | Bradshaw | 52/20 |
| 2,930,295 | 10/1957 | Hale | 404/26 |
| 3,000,276 | 9/1961 | Foulger | 404/82 X |
| 3,240,133 | 3/1966 | Ross | 404/26 |
| 3,331,295 | 2/1967 | Sorrell | 404/26 |
| 3,629,981 | 5/1971 | McCaffery | 52/19 |
| 3,858,998 | 4/1975 | Larsson et al. | 404/26 |
| 3,926,533 | 1/1975 | Binette | 404/26 |
| 4,075,796 | 7/1978 | Cuozzo | 52/20 |
| 4,174,183 | 4/1979 | Ferns | 404/26 |
| 4,231,201 | 11/1980 | Harnois | 52/20 X |
| 4,337,005 | 7/1982 | LeBaron | 404/26 |

FOREIGN PATENT DOCUMENTS

| | | | |
|---|---|---|---|
| 478300 | 10/1969 | Switzerland | 404/25 |

OTHER PUBLICATIONS

"Sewer Products by QWP", publ. Quality Water Products, Inc., South Barre, Mass.

*Primary Examiner*—Stephen J. Novosad
*Assistant Examiner*—John F. Letchford
*Attorney, Agent, or Firm*—Rines and Rines, Shapiro and Shapiro

[57] ABSTRACT

An adjustable leveling structure for manhole covers, grates and the like within ground and similar structures which comprises an annular-walled ring for supporting a cover, grate and the like near its upper edge and mechanically compressible resilient layer means shaped to conform to the wall of the annular ring and disposed in the space between the outer wall of the annular ring and the ground or similar structure when the annular ring is vertically displaced.

20 Claims, 8 Drawing Figures

METHOD OF AND APPARATUS FOR ADJUSTABLY LEVELING MANHOLE COVERS, GRATES AND THE LIKE

This application is a continuation of application Ser. No. 551,583 filed Nov. 14, 1983, now abandoned.

The present invention relates to support structures for roadbed manhole covers, grates and the like, being more particularly directed to a method and apparatus to extend, raise or otherwise change or adjust the level of the supporting structure and thus the manhole cover or similar device, as may be required in road re-surfacing or other wear correction applications.

This art is replete with a wide variety of structures proposed and used through many years to try to provide a facile construction and method for these and related purposes. As examples, concentric rotational adjustment structures date back before the turn of the century, at least to U.S. Pat. No. 638,692, with recent threaded versions appearing in U.S. Pat. Nos. 3,629,981 and 4,075,796. Bolts and similar mechanisms for adjusting the support level are illustrated in U.S. Pat. Nos. 2,930,295 and 3,858,998. Special inserts, including extension rings, are described in, for example, U.S. Pat. Nos. 3,240,133; 3,331,295; 3,926,533; 4,337,005 and 4,174,183. Less cumbersome methods have been proposed such as the Quik-Rise® system described in a publication entitled "SEWER PRODUCTS by QWP" published by Quality Water Products, Inc., South Barre, Massachusetts. These and other similar constructions and methods have left much to be desired, apart from either requiring separate inserts or devices or relatively costly or awkward mechanisms, including threaded or specially shaped mechanisms, and often causing hazardous instability problems, such as wobbling, in the event perfect fits are not always attained or mechanisms become loosened, wear or are dislodged. Additionally, environmental conditions, primarily water seepage from the ground or other similar supporting structures, cause corrosion of the aforementioned insert structures which leads to a freezing or locking of the mechanisms and a bonding of the apparatus to the ground or other supporting structure, requiring a lengthy and expensive replacement operation.

Additionally, with many prior methods and apparatus and specifically with the conically tapered Quik-Rise® system, noted above, the raising of the manhole cover supporting structure causes an increasing gap to be formed between the ground and the supporting structure which requires an additional complex re-centering operation to align the supporting structure within the hole during re-surfacing. Also, the fit within the hole is critically dependent on the smooth and accurate formation of the walls of the hole to receive or re-receive the supporting structure.

It is to the improved solution of these problems that the present invention is accordingly directed; it being an object of the invention to provide a novel method of and apparatus for providing adjustable leveling of manhole covers, grates and the like, that shall not be subject to the above-described disadvantages and others of the prior art, but that, to the contrary, shall be relatively inexpensive, reliable and simple.

A further object is to provide an apparatus that will not buckle, pop-out, or otherwise lose structural integrity and level stability in conjunction with ground and similar structures subject to various expansion/contraction effects.

A still further object is to provide such an improved manhole cover or similar adjustable-level support structure that does not require drastic departure from present-day types of installations, but can readily be adapted for use with a wide variety of current support structures.

Other and further objects will be explained hereinafter and are more particularly delineated in the appended claims.

In summary, the invention contemplates apparatus for providing adjustable leveling of manhole covers, grates and the like within ground and similar structures which comprises an annular ring for supporting a cover, grate and the like near its upper edge, and flexible means positioned substantially between the annular ring and the ground or similar structure, adapted to reduce the friction between the annular ring and the ground or similar structure when the annular ring is moved within the ground or similar structure in order to adjust the level of the manhole cover, grate and the like. Preferred details and best mode embodiments are hereinafter presented.

The invention will now be described with reference to the accompanying drawing,

FIG. 1 of which is a cut-away isometric view showing a portion of a preferred supporting structure, constructed in accordance with the invention, seated within the ground or similar structure;

Figure 1:
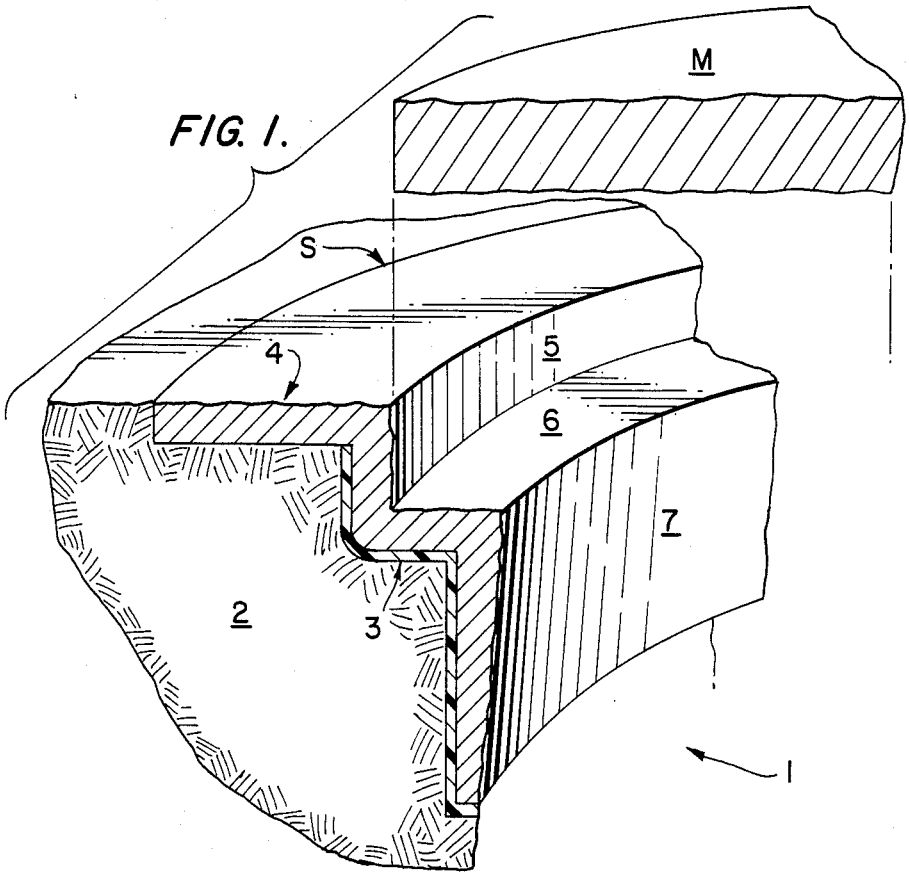

The number 1 in FIG. 1 refers to an apparatus for providing adjustable leveling of a manhole cover M or the like within ground 2. The ground 2 may be composed of soil, rocks, pavement, brick, concrete or other similar materials. The apparatus 1 is composed essentially of a manhole, grate or similar supporting structure S, depicted in the form of an annular ring or frame, shown circularly cylindrical though other polygonic shapes, including square or rectangular, may be used, and a resilient flexible material 3 such as polyethelene or other plastic sheets, bitumen impregnated cloth or paper, roofing paper or other substantially non-porous water-impermeable material.

Figure 2:
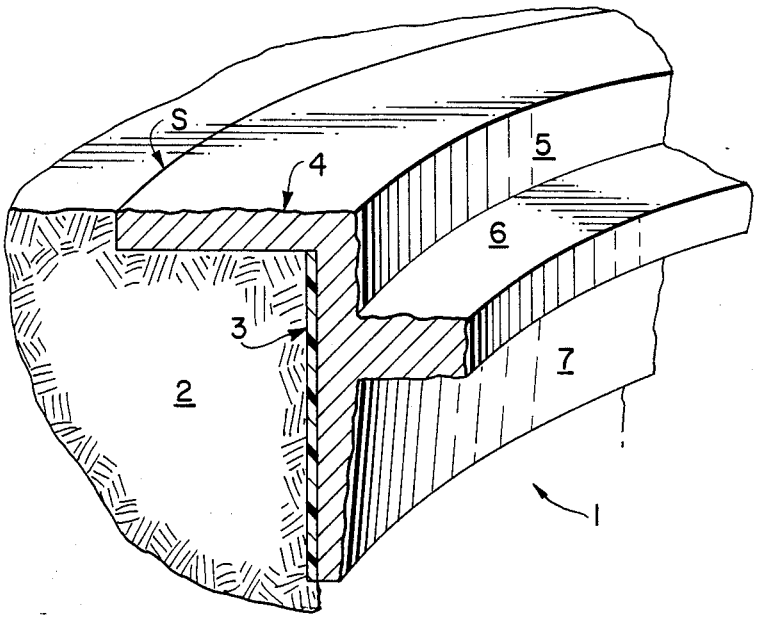
FIG. 2 is a view similar to FIG. 1, showing a portion of another form of preferred supporting structure seated within the ground or similar structure.
Figure 5:
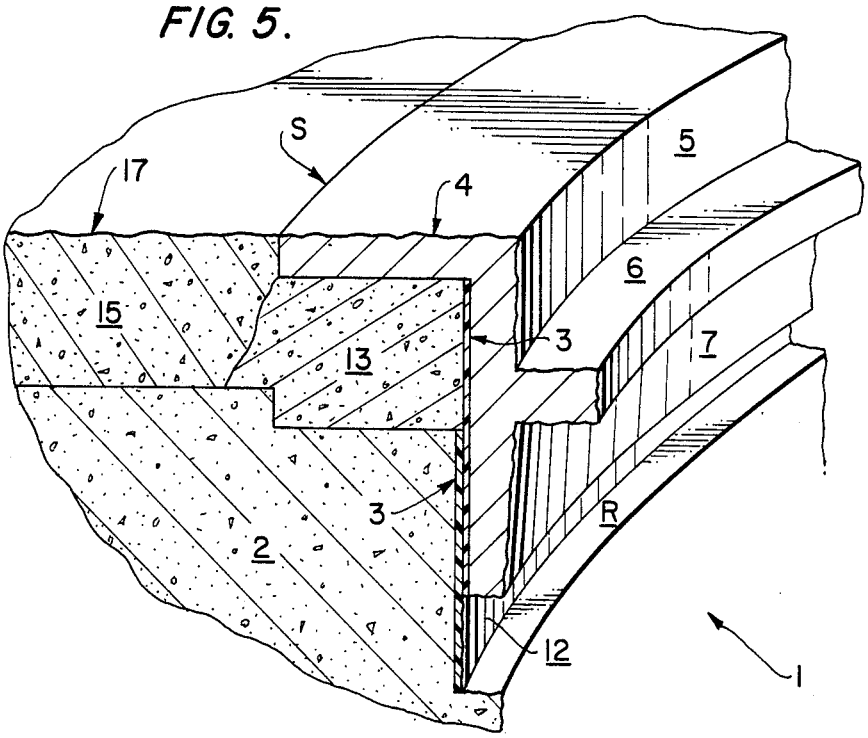
FIG. 5 is a view similar to FIG. 4, showing the supporting structure secured at a new desired height with a new surface level of ground, or similar structure surrounding the supporting structure.
Figure 8:
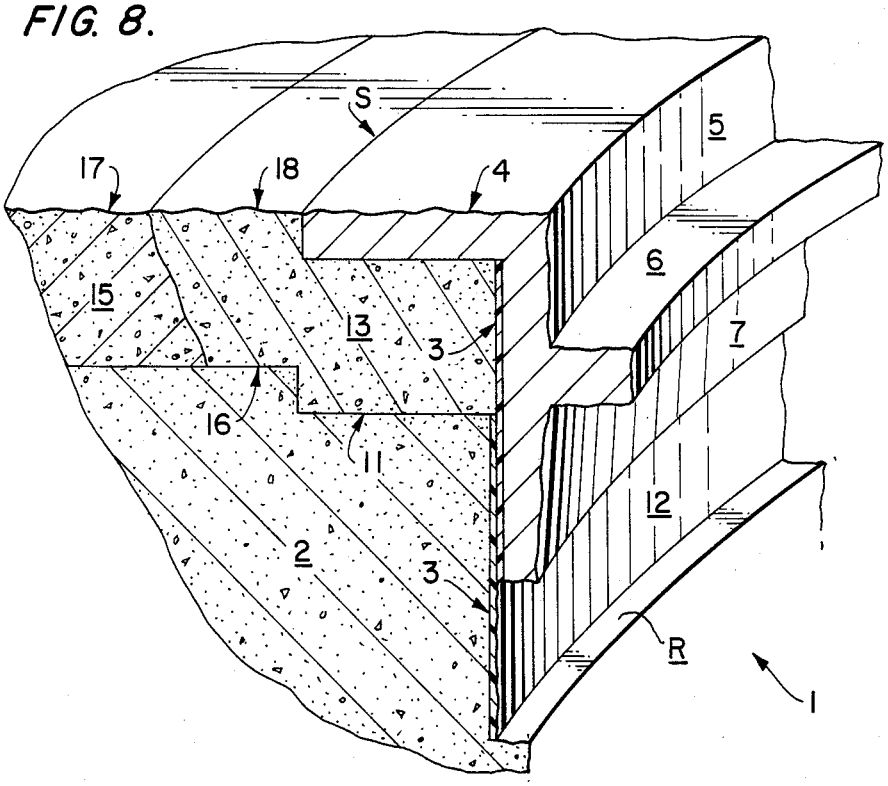
FIG. 8 is a view similar to FIGS. 5 and 7 showing the supporting structure secured at the new desired height with a new surface level of ground, or similar structure surrounding the supporting structure.

The supporting structure S, commonly referred to in the art as a slab-type manhole cover support structure, has an upper flange 4 that extends radially outward from the cylindrical portion of the support structure, and is normally positioned flush with the surface of the ground 2, as shown in FIGS. 1 and 2, or flush with a ground covering surface, as shown in FIGS. 5 and 8. At the innermost edge of the upper flange 4 is a seat for receiving and supporting a manhole cover M or the like that is shown formed by a concentric cylindrical inner wall portion 5 and a concentric cylindrical internal flange 6. The height of the wall portion 5, between the upper surface of the internal flange 6 and the upper surface of the upper flange 4, is approximately equal to the thickness of the manhole cover M. Therefore, when the manhole cover M is placed in the seat it is supported by the internal flange 6 along an area about the perimeter of the manhole cover M with the top surface approximately flush with the top surface of the upper flange 4.

The supporting structure S additionally has a cylindrical sleeve 7 securely attached to the innermost portion of the internal flange 6, as shown in FIG. 1, or attached to the outermost portion of the internal flange 6 and forming a uniform cylindrical wall in conjunction with the wall portion 5, as shown in FIGS. 2 through 8. Other forms are anticipated, including increased thickness and tapering cylindrical sleeves that contact the entire internal flange 6 and sleeves that taper inwards towards the center of the primarily cylindrical support structure S. In any case, it will be appreciated that the sleeve 7, outermost portion of flange 6 and the wall 5 constitute a substantially annular wall which, as shown in the drawings, extends into ground 2.

In the original installation operation, the resilient material 3 is wrapped or shaped around the cylindrical outer wall sections of the support structure S to conform to and abut the same, and a slab of ground 2 is formed around the support structure S, such as with the common practice of pouring a concrete slab around a manhole support structure, such that the resilient material 3 resists contact between the ground 2 and the support structure S. Being flexible, the resilient material 3 is normally in the form of sheets that are wrapped around the support structure S, but may be brushed, washed, sprayed or extruded on to the support structure S as necessary. The support structure S is surrounded by a hole such that the upper surface of the upper flange 4 is flush with the surface of the ground 2 or ground covering and rests on an upper lip of the interior wall of the hole, as shown in FIGS. 1 and 2, with the major portion of the generally annular wall constituted by the sleeve 7, the outermost portion of flange 6 and the wall portion 5 extending past the aforementioned upper lip into the hole. The forming operation compresses the flexible material 3 against the interior wall of the hole with the material 3 extending into the hole from the upper lip of the interior wall, as seen in FIGS. 1 and 2. The support structure S is then prepared to receive and support the manhole cover M as described previously.

Figure 3:
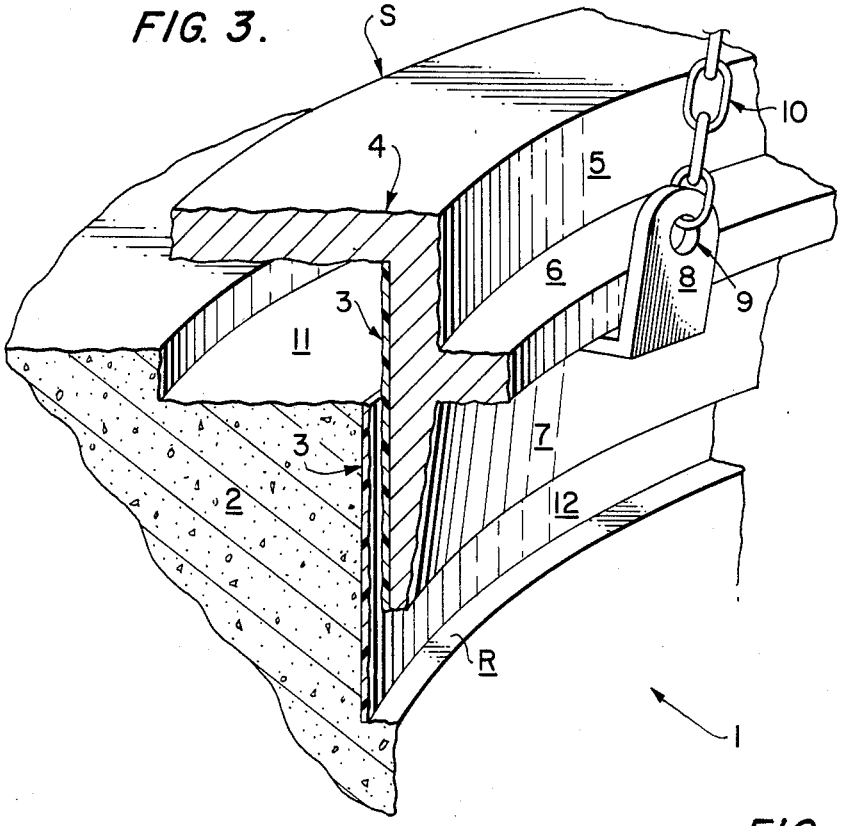
FIG. 3 is a view similar to FIG. 2, illustrating a portion of the removal operation of the supporting structure from the ground or similar structure.

Additionally, in view of the use of the resilient material 3, a novel installation process can be achieved. Specifically, for the original installation process, a presized hole is prepared in the ground 2 of a diameter approximately equal to the diameter of the support structure S. The flexible material 3 is then placed around the inside of the hole or around the outer circumference of the support structure S, or both (FIG. 3.). The flexible material may be placed either around the support structure or on the walls of the hole, or both, as necessary. The support structure S is then inserted into the hole such that the upper surface of the upper flange 4 is flush with the surface of the ground 2 or ground covering. This insertion compresses the flexible material, as noted above and as shown in FIGS. 1 and 2. Since the flexible material 3 can compressively compensate for irregularities in the hole surface, so long as the hole is not smaller than the size of the support structure S, a proper insertion can be accomplished.

By using the flexible material 3 as a buffer between the support structure S and the ground 2, a slightly larger and irregular hole can be used to hold the support structure S, as the compressible material will fill any small spaces between the ground 2 and the support structure S and accept non-destructive compression when space is lacking. Therefore, less accurate holes in the ground 2 need to be produced to hold the support structure S than would be needed without the flexible material 3 and surface irregularities of the support structure S are absorbed.

When the level of the support structure S must be changed, for example, to facilitate the re-surfacing of a roadway, the support structure S can be easily removed from the ground 2 as shown in FIG. 3. To remove the support structure S, a clamp or hook, such as L-hook 8, is secured under the internal flange 6. The L-hook 8 is attached by an eyelet 9 to a chain 10 which is drawn away from the support structure S and the ground 2 by a device such as a back-hoe or tractor (not shown). When sufficient tensile force is exerted on the chain 10, and therefore sufficient lifting force is exerted on the support structure S, the support structure S is removed from or raised in the hole, as shown in FIG. 3.

For most raising operations the desired change in height is less than the length of the cylindrical support structure. Under these circumstances, the extended cylindrical sleeve 7 retains the support structure S centered within the supporting hole during the raising and re-surfacing operations without the need to resort to complicated re-positioning methods and apparatus.

When lifting force is exerted on the support structure S, frictional force exerted on the support structure S by the flexible material 3 tends to oppose the upward movement of the support structure S. The flexible material is designed to provide less frictional resistance to movement than would be obtained by a support structure-ground or support structure-ground covering material interface. The different frictional resistance can be obtained by using the flexible material 3 in differing constructions or by using different types of flexible materials. A preferred method of construction includes the use of two or more sheets of plastic material, such as polyurethane, that have a minimal coefficient of friction between them. Therefore, when the support structure S is raised, the plastic sheets provide minimal resistance to the lifting force. Another example that is contemplated includes the use of bitumen impregnated materials, such as paper, which include bitumen coated materials, that have a friction coefficient higher than the shear strength of the matrix material (paper or cloth) and a shear strength less than the support structure-ground friction coefficient. With this condition, the center portion of the material will shear when the support structure S is raised, while both surfaces of the material continue to engage their respective portions of the ground 2 or the support structure S, (FIG. 3, for example).

Figure 4:
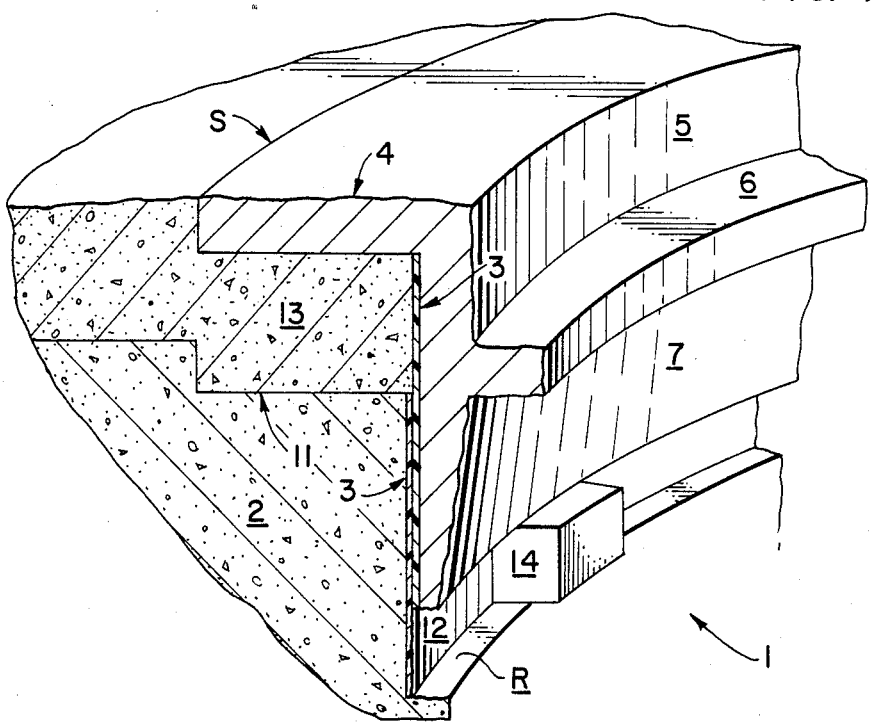
FIG. 4 is a view similar to FIG. 3, showing the supporting structure held at a desired height above the original position.

When the support structure S is raised, one or more support blocks 14, FIG. 4, are inserted into a gap 12 prior to the release of tension on the chain 10 and the removal of the L-hook 8. With the support blocks 14 inserted into the gap 12, the support structure S is rigidly held at the desired height. New ground covering material 13, such as concrete, asphalt, brick, soil or other similar materials, is now inserted into the gap 11, with sufficient flexible material 3 remaining in contact with the support structure S at all points to preclude the ground 2 or new ground covering material 13 from directly contacting the support structure S, as seen in FIG. 4.

After the new ground covering material 13 has obtained sufficient structural strength, the support blocks 14 may be removed, allowing the ground covering material to support the support structure S. Alternatively, the chain 10 could be held in tension to support the support structure S until the new ground covering material can function as a support and the support blocks 14 need not be used. After the support structure S is properly supported, a new surface of ground covering material 15, such as concrete, asphalt, brick, soil or other similar materials, is then placed over the ground 2 such that the upper surface 17 of the ground covering material 15 is essentially flush with the upper surface of the upper flange 4 of the support structure S, as shown in FIG. 5.

Where the separating material 3 is of proper resilience and the lifting distance is not excessive, the friction alone may hold the range or frame in proper position without the help of blocks or chain or other means.

Figure 6:
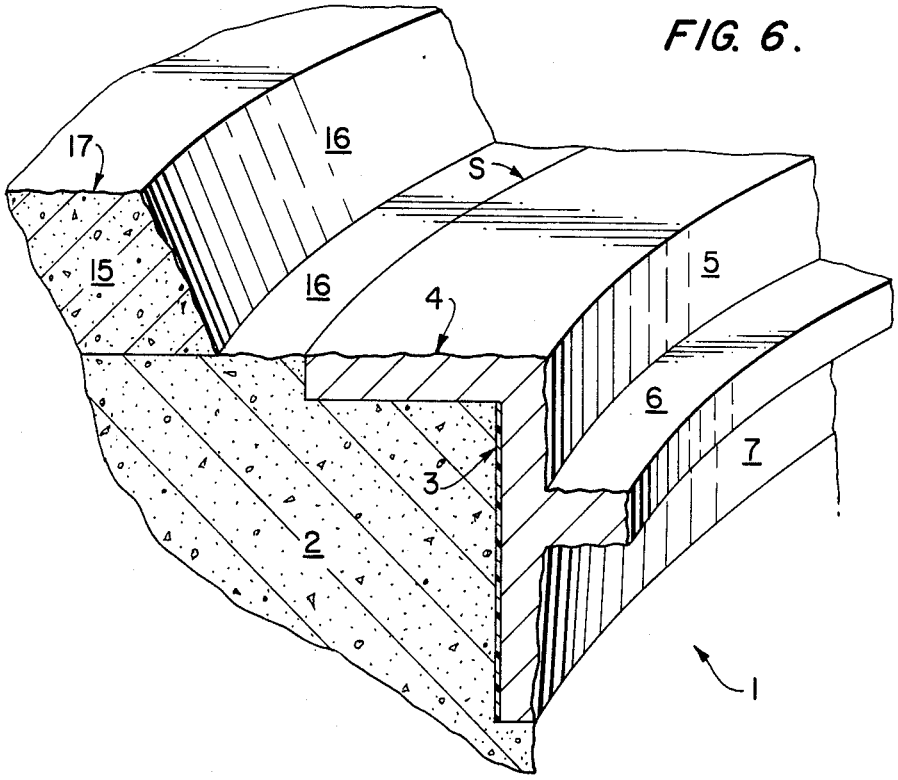
FIG. 6 is a view similar to FIG. 2, showing the supporting structure supported at a height below a desired height.
Figure 7:
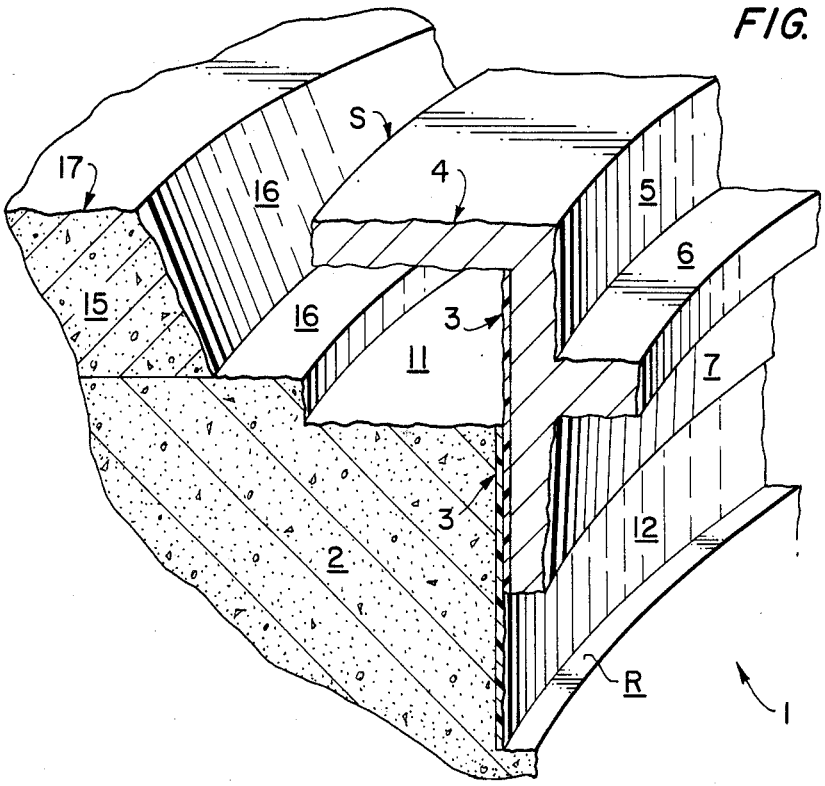
FIG. 7 is a view similar to FIG. 6, showing the supporting structure suspended at the desired height above the surrounding ground or similar structure.

Alternatively, as shown in FIG. 6, the ground covering material 15 may be placed around the support structure S, prior to height readjustment, leaving a space 16 between the ground covering material 15 and the support structure S. The support structure S is then raised and supported in a manner as discussed previously, and shown in FIG. 7 (support not shown). New ground covering material 13 is then placed into the gap 11 and space 16 such that the upper surfaces 17 and 18 of the ground covering materials 15 and 13, respectively, are effectively flush with the upper surface of the upper flange 4, as shown in FIG. 8. After the ground covering material 13 has obtained sufficient structural strength to support the support structure S, any other supporting means, such as L-hook 8 and chain 10 or blocks 14 may be removed as explained previously.

With support structure S and manhole cover M installed in accordance with the present invention, a greater resistance to structural degradation and damage is achieved in comparison with normal manhole cover structures. Since the thermal expansion of the manhole cover support structure S and the surrounding ground 2 is rarely similar, changes in surrounding temperatures, as experienced by seasonal changes, cause different amounts of expansion and contraction in the support structure S and the ground 2. Without the flexible material 3, expansion of the ground 2 and support structure S would tend to cause the support structure S to buckle or pop out of the ground 2, and the ground 2 to buckle and heave. Additionally, without the flexible material 3, contraction of the ground 2 and the support structure S would create a gap between the walls of the hole in the ground 2 and the outer wall portion of the support structure, reducing the structural integrity and support of the arrangement and allowing for tipping or collapsing of the manhole cover M-supporting structures. The present invention provides a flexible material 3 as a buffer between the support structure S and the ground 2 and ground coverings 13 and 15. The flexible material can be non-destructively compressed and expanded to fill small cavities as necessary. Therefore, with proper installation, the present invention can compensate for the thermal expansion and contraction normally encountered in the year-round continuous use of the manhole cover.

Additionally, since the flexible material 3 is a water impermeable or resistant material, the support structure S, which is normally made of metal, is protected from contact with the surrounding ground and ground water. The protection afforded by the flexible material 3 decreases the corrosion and material degradation of the support structure S and, therefore, increases its effective life. Further modifications will also occur to those skilled in this art and such are considered to fall within the spirit and scope of the invention as defined in the appended claims.

What is claimed is:

1. Apparatus for providing adjustable leveling of manhole covers, grates and the like within ground and similar structures, which comprises a substantially annular ring for supporting a cover, grate and the like near its upper edge, said ring having a substantially annular wall portion with a non-tapered outer surface disposed within an interior wall of a hole in the ground or similar structure and extending deep into said hole from an upper lip of said interior wall, and mechanically compressible resilient layer means shaped to conform to said non-tapered outer surface of said annular wall portion of said ring and disposed within said hole in abutment between said interior wall of said hole and said non-tapered outer surface of said annular wall portion of said ring for reducing sliding friction between said outer surface of the annular ring and the ground or similar structure when the annular ring is vertically displaced within the ground or similar structure in order to adjust the level of the manhole cover, grate and the like, said resilient layer means extending deep into said hole from said upper lip of said interior wall and along the length of said non-tapered outer surface.

2. Apparatus as claimed in claim 1 and in which the said compressible resilient layer means has a shear or tensile force small compared with the force that would be needed to overcome the friction between the annular ring and the ground or similar structure.

3. Apparatus as claimed in claim 1 and in which said compressible resilient layer means has a low coefficient of sliding friction compared to that of the ring if embedded directly in the ground or similar structure.

4. Apparatus as claimed in claim 1 and in which said compressible resilient layer means is formed from two or more abutting sheets.

5. Apparatus as claimed in claim 4 and in which the force needed to overcome the friction between the sheets is less than the force needed to overcome the friction between the annular ring and the ground or similar structure.

6. Apparatus as claimed in claim 1 and in which the layer means is of resilient plastic material.

7. Apparatus as claimed in claim 1 and in which the layer means is of bitumen-impregnated paper.

8. Apparatus as claimed in claim 1 and in which the layer means is of water-impermeable material.

9. Apparatus for providing adjustable leveling of manhole covers, grates and the like within ground and similar structures, which comprises a substantially annular ring for supporting a cover, grate and the like near its upper edge, said ring having a substantially annular wall portion with a substantially cylindrical outer surface which is disposed within an interior wall of a hole in the ground or similar structure and which extends deep into said hole from an upper lip of said interior wall, and mechanically compressible resilient layer means shaped to conform to said outer surface of said annular wall portion of said ring and disposed within said hole in abutment between said interior wall of said hole and said outer surface of said annular wall portion of said ring for reducing sliding friction between said outer surface and the ground or similar structure when said ring is vertically displaced within the ground or similar structure in order to adjust the level of the manhole cover, grate and the like, said resilient layer means extending deep into said hole from said upper lip of said interior wall and along the length of said outer surface.

10. Apparatus as claimed in claim 9 and in which said compressible resilient layer means has a shear or tensile force small compared with the force that would be needed to overcome the friction between said ring and the ground or similar structure.

11. Apparatus as claimed in claim 9 and in which said compressible resilient layer means has a low coefficient of sliding friction compared to that of said ring if embedded directly in the ground or similar structure.

12. Apparatus as claimed in claim 9 and in which said compressible resilient layer means is formed from two or more abutting sheets.

13. Apparatus as claimed in claim 12 and in which the force needed to overcome the friction between the sheets is less than the force needed to overcome the friction between said ring and the ground or similar structure.

14. Apparatus as claimed in claim 9 and in which said compressible resilient layer means in one of resilient plastic material and bitumen-impregnated paper.

15. A method of installing adjustable leveling manhole covers, grates and the like within ground and similar structures, which comprises, creating a hole in the ground or similar structure that has an interior wall which is somewhat larger in cross dimension than the outer dimensions of a manhole coverreceiving annular ring which has an annular wall portion with a non-tapering outer surface of sufficient length to extend deep within said hole, inserting the ring within the hole in such a manner that said annular wall portion of said ring is disposed within said interior wall and extends deep into said hole from a position adjacent an upper lip of said interior wall, and positioning a compressible resilient material between the interior wall of the hole and said nontapered outer surface of the annular wall portion of the ring in such a manner that said material extends into said hole along the length of said outer surface from said upper lip of said interior wall, to compress said material between the length of said outer surface and the interior wall of the hole.

16. A method of adjustably leveling manhole covers, grates and the like within ground and similar structures, which comprises, raising from a hole in the ground or similar structure a manhole cover-receiving annular ring which has an annular wall portion with a non-tapered outer surface extending deep into the hole, adjusting the surface level of the hole to provide the hole with an interior wall portion which surrounds the annular ring and which has an upper lip at a desired height, positioning a compressible resilient material along the interior wall of the hole in such a manner that the resilient material extends from said upper lip deep into the hole along said interior wall portion, and re-inserting the manhole cover-receiving annular ring into the hole such that said outer surface extends deep into the hole, said resilient material is in contact with said outer surface and said interior wall portion, and said resilient material extends deep into the hole from said upper lip along the length of said outer surface.

17. A method as claimed in claim 16 and in which said raising includes raising the said annular ring from the ground without developing appreciable lateral clearance between the ground and the ring, and in which said adjusting includes inserting support material between an upper flange of the ring and the ground.

18. A method of adjustably leveling an annular ring for supporting manhole covers, grates and the like within a hole in the ground and similar structures, the ring having a substantially annular wall portion with a non-tapered outer surface extending deep into said hole from adjacent an upper lip of the hole and resilient layer means in contact between said outer surface, along the length of said surface, and an interior wall of said hole, said method comprising raising said annular ring by a distance less than the length of said outer surface so that said resilient layer means remains in contact between said outer surface and said interior wall to avoid developing appreciable lateral clearance between the ground and the ring, and inserting support material between an upper flange of the ring and the ground.

19. A method as claimed in claim 18 and in which the steps are performed of newly paving an area about the ring and leaving working clearance around the ring to form a space defined by new paving, the ground or similar structure and said ring prior to said raising, and applying support material in said space.

20. A method as claimed in claim 19 and in which the ring is overlifted and forced down to finished grade, thereby compacting or extruding the said support material.

* * * * *